US011678110B2

(12) United States Patent
Morishita et al.

(10) Patent No.: US 11,678,110 B2
(45) Date of Patent: Jun. 13, 2023

(54) ELECTRONIC APPARATUS

(71) Applicant: SHARP KABUSHIKI KAISHA, Sakai (JP)

(72) Inventors: Keita Morishita, Sakai (JP); Mitsunori Tanaka, Sakai (JP); Harutaka Uno, Sakai (JP); Daisuke Kuroda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/710,159

(22) Filed: Mar. 31, 2022

(65) Prior Publication Data

US 2022/0321994 A1 Oct. 6, 2022

(30) Foreign Application Priority Data

Apr. 6, 2021 (JP) ..... JP2021-064833

(51) Int. Cl.

| | |
|---|---|
| ***H04R 1/34*** | (2006.01) |
| ***H04R 1/02*** | (2006.01) |
| ***H04R 1/08*** | (2006.01) |
| ***H04R 1/04*** | (2006.01) |

(52) U.S. Cl.

CPC ..... *H04R 1/342* (2013.01); *H04R 1/028* (2013.01); *H04R 1/04* (2013.01); *H04R 1/08* (2013.01); *H04R 2499/15* (2013.01)

(58) Field of Classification Search

CPC ..... H04R 1/342; H04R 1/028; H04R 1/04; H04R 1/08; H04R 2499/15

See application file for complete search history.

(56) References Cited

FOREIGN PATENT DOCUMENTS

| | | | |
|---|---|---|---|
| JP | H0895582 A | * | 4/1996 |
| JP | 2008-193249 A | | 8/2008 |

* cited by examiner

*Primary Examiner* — Kile O Blair

(74) *Attorney, Agent, or Firm* — ScienBiziP, P.C.

(57) ABSTRACT

An electronic apparatus includes a housing having a sound receiving hole that guides a sound outside the housing into the housing, a substrate that is disposed in the housing and on which a microphone is mounted, an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole, and a first member that is disposed so as to partially occupy the space.

15 Claims, 9 Drawing Sheets

ELECTRONIC APPARATUS

BACKGROUND

1. Field

The present disclosure relates to an electronic apparatus.

2. Description of the Related Art

In the field of electronic apparatuses, such as TV receivers, tablets, and cellular phones, that are equipped with microphone mechanisms, various technologies for improving sound receiving levels have been developed. For example, Japanese Unexamined Patent Application Publication No. 2008-193249 discloses an electronic apparatus (a cellular phone) that has the following configuration.

A front housing of the electronic apparatus has a plurality of sound receiving holes for picking up a sound from the outside, and a substrate that is disposed in the housing and on which a microphone is mounted has a sound guiding hole for guiding a sound to the microphone. The sound that enters the housing from the sound receiving holes is guided to the microphone through the sound guiding hole. In order to prevent leakage of the sound from any space other than the sound receiving holes, an elastic member (a wall unit) is disposed in a space between the housing and the substrate in such a manner as to surround the sound receiving holes. The elastic member has a hole for guiding the sound to the microphone.

Here, for example, in the case of a near-field microphone that picks up a sound near an apparatus like a microphone of a cellular phone does, a reasonably large space may be formed in the housing.

In contrast, for example, in the case of a far-field microphone that picks up a sound at some distance from an apparatus like a microphone of a TV receiver does, the narrower the space formed in the housing, the better the acoustic characteristics of sound collection. Thus, the hole formed in the elastic member covering the space between the housing and the substrate may be small. However, if the hole formed in the elastic member is small, it becomes difficult to align the hole formed in the elastic member, the sound receiving holes, and the sound guiding hole in a manufacturing process, and there is a possibility that a space that is the path of the sound will be blocked at the time of assembly.

SUMMARY

According to an aspect of the disclosure, there is provided an electronic apparatus including a housing having at least one sound receiving hole that guides a sound outside the housing into the housing, a substrate that is disposed in the housing and on which a microphone is mounted, an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole, and a space-occupying member (hereinafter also referred to as a "first member") that is disposed so as to partially occupy the space.

DESCRIPTION OF THE EMBODIMENTS

An embodiment according to an aspect of the present disclosure (hereinafter also referred to as the "present embodiment") will be described below with reference to the drawings.

Embodiment

The embodiment of the present disclosure will be described below with reference to the drawings.

<Configuration of TV Receiver>

Figure 1:
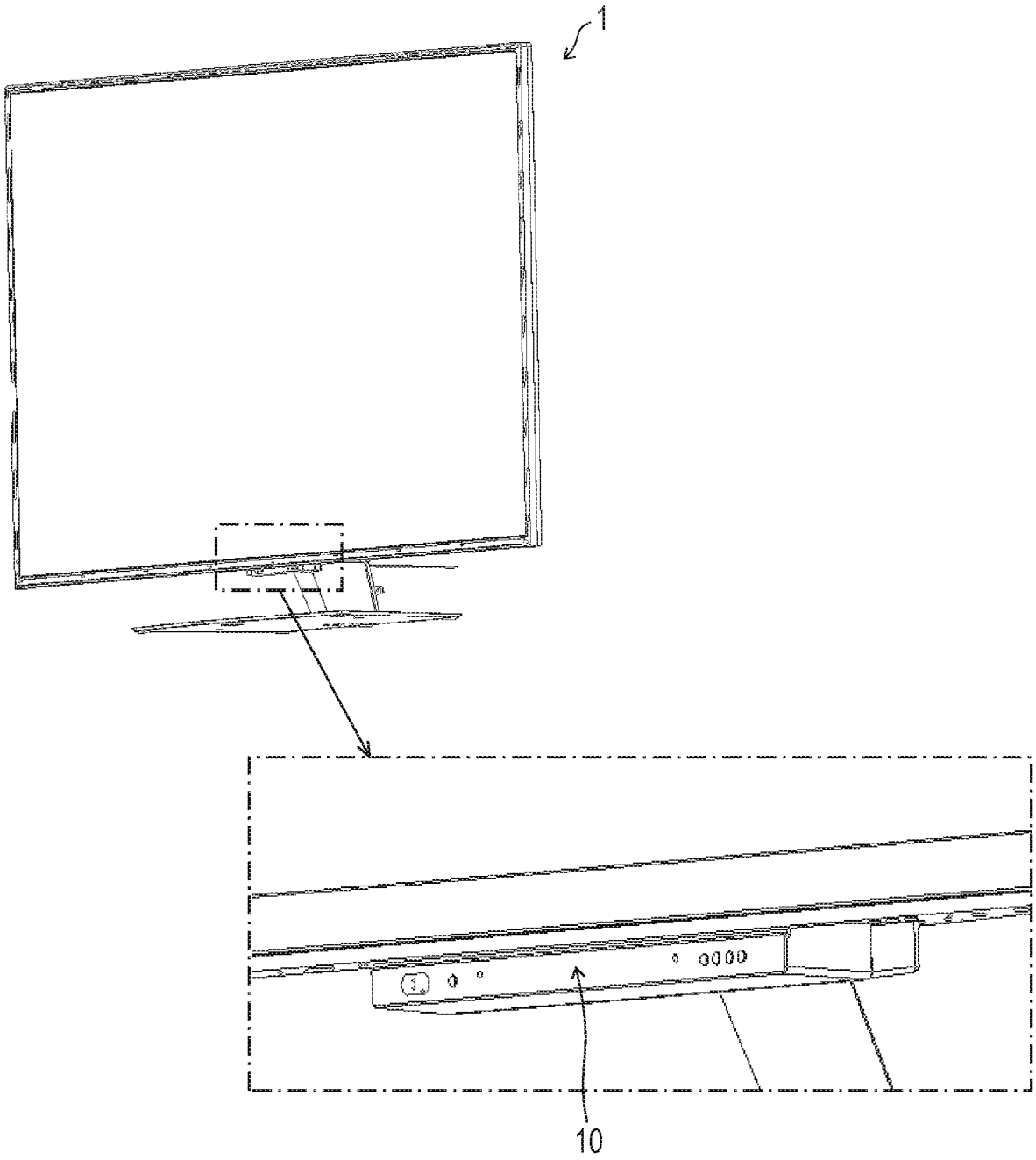
FIG. 1 includes a perspective view illustrating an example of the appearance of an electronic apparatus (a TV receiver) according to an embodiment of the present disclosure and an enlarged view of a portion illustrated in the perspective view.

FIG. 1 is a perspective view illustrating an example of the appearance of an electronic apparatus (a TV receiver) 1 according to the present embodiment. The electronic apparatus to which the present disclosure is applied may be a tablet or the like other than a TV receiver. A microphone unit apparatus 10 is disposed on the bottom of a screen of the TV receiver 1. The configuration of the microphone unit apparatus 10 will be described below. Note that, in the following description, the side on which the screen of the TV receiver 1 is located will be referred to as the front side (or the front surface), and the side opposite to the front side will be referred to as the rear side (or the rear surface).

<Configuration of Microphone Unit Apparatus>

Figure 2:
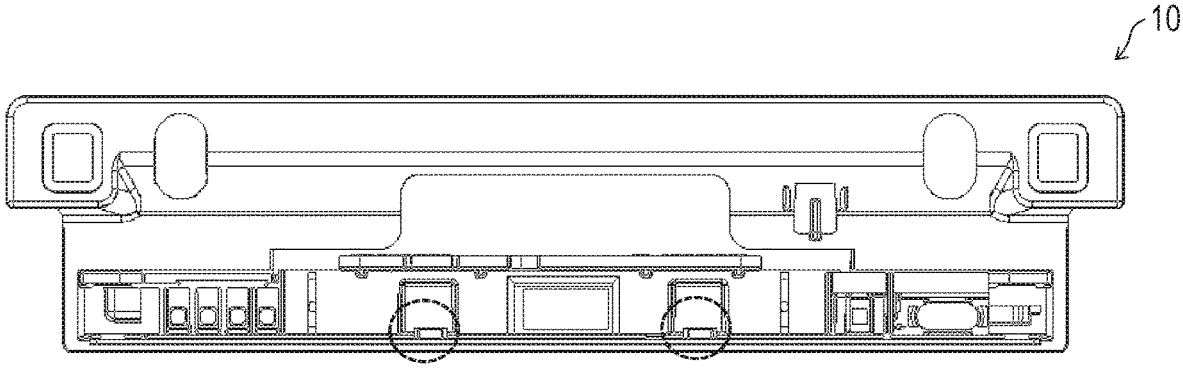
FIG. 2 is a rear view of a microphone unit apparatus that is included in the electronic apparatus illustrated in FIG. 1.
Figure 3:
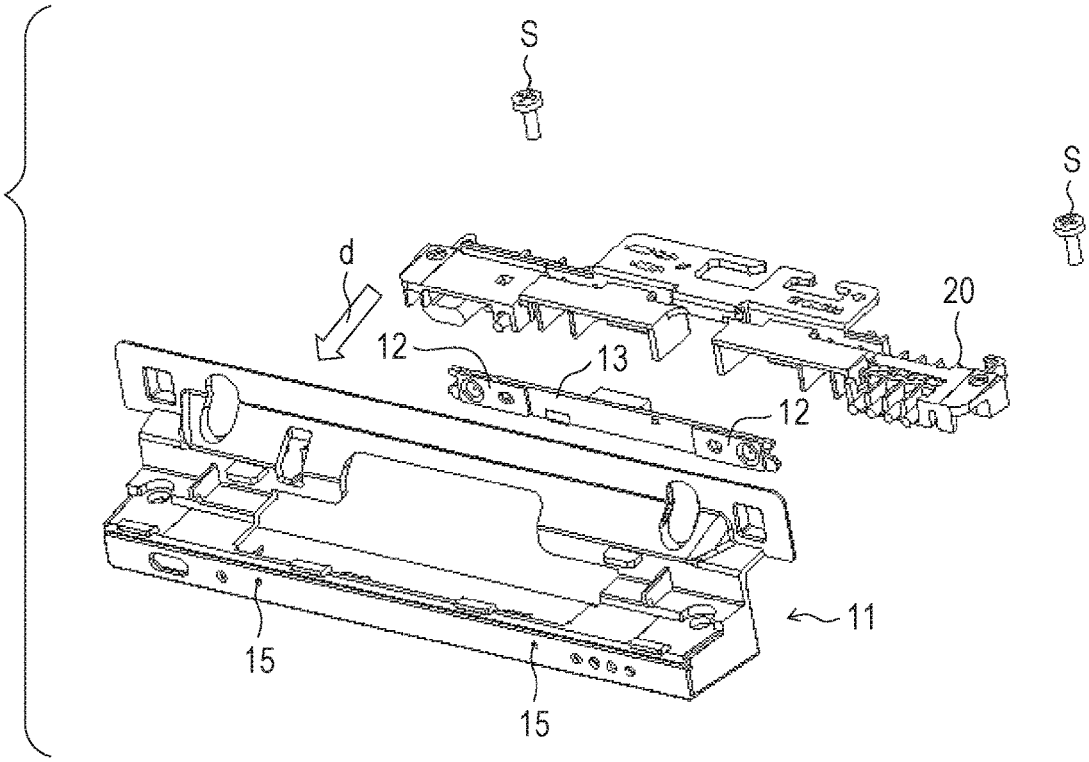
FIG. 3 is an exploded perspective view of the microphone unit apparatus illustrated in FIG. 2.

FIG. 2 is a rear view of the microphone unit apparatus 10, and FIG. 3 is an exploded perspective view of the microphone unit apparatus 10 when viewed from the front side. As illustrated in FIG. 3, the microphone unit apparatus 10 includes a housing 11, a substrate 13, and a substrate holder 20 that are assembled with fixing screws S.

The housing 11 is made of, for example, a material such as polycarbonate and covers the front surface side of the microphone unit apparatus 10. Two sound receiving holes 15 that guide a sound outside the housing 11 into the housing 11 are formed at positions each of which is spaced apart from the center of the housing 11 by approximately the same distance in a transverse direction.

Two microphones 14 are mounted on the substrate 13. The substrate 13 is formed of, for example, a printed circuit board, and in addition to the microphones 14, various components forming the microphone unit apparatus 10 are mounted on the substrate 13. The components include, for example, a connector, a resistor, a capacitor, and so forth.

The positions of the two sound receiving holes 15, which are formed in the housing 11, each correspond to the position of one of the two microphones 14. In addition, elastic members 12 are arranged so as to fill the gap between the substrate 13 and an inner wall of the housing 11 excluding portions of the inner wall that are located around the sound receiving holes 15 and so as to form spaces between the substrate 13 and the portions of the inner wall of the housing 11, which are located around the sound receiving holes 15.

As illustrated in FIG. 3, the substrate holder 20 is disposed on the rear side of the substrate 13 so as to press the substrate 13 against the housing 11 from the rear as indicated by arrow d, so that the elastic members 12 can be held in a state of being compressed, and the substrate 13 can be brought into close contact with the housing 11.

Figure 4:
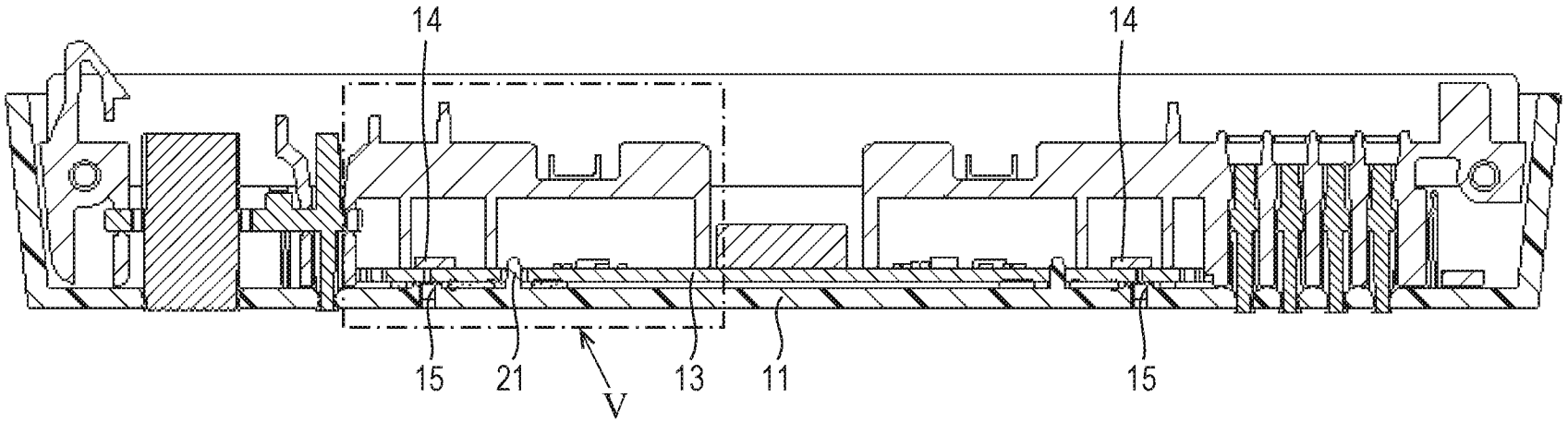
FIG. 4 is a sectional view of the microphone unit apparatus illustrated in FIG. 2 when viewed from the top surface.

FIG. 4 is a sectional view of the microphone unit apparatus 10, which is assembled as described above, when viewed from the top surface. In FIG. 4, the lower side corresponds to the front side of the TV receiver 1 (and the microphone unit apparatus 10), and the upper side corresponds to the rear side of the TV receiver 1.

Figure 5:
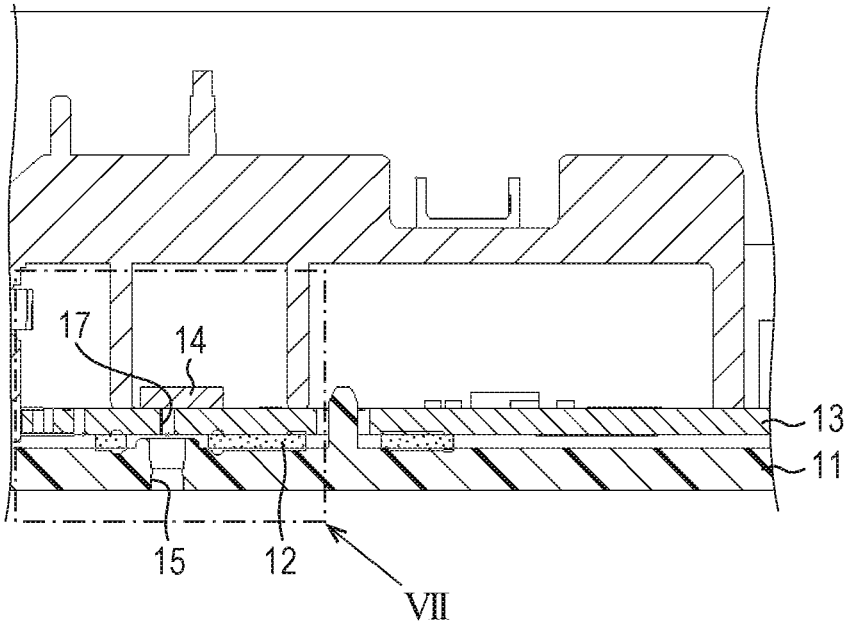
FIG. 5 is an enlarged view of a portion that is surrounded by a one-dot chain line frame V in FIG. 4.
Figure 6:
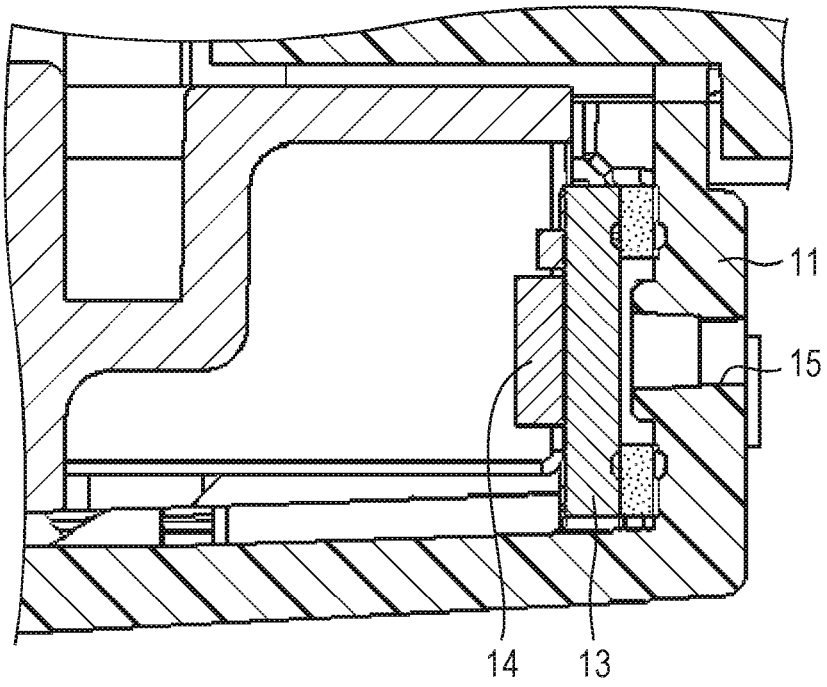
FIG. 6 is a side sectional view of the microphone unit apparatus illustrated in FIG. 2.

FIG. 5 is an enlarged view of a portion that is surrounded by a one-dot chain line frame V in FIG. 4 and is a diagram illustrating the configuration of the peripheral portion of one of the two microphones 14, which are included in the microphone unit apparatus 10. FIG. 6 is a side sectional view illustrating a cut surface including one of the microphones 14 of the microphone unit apparatus 10. In FIG. 6, the right-hand side corresponds to the front side of the TV receiver 1, and the left-hand side corresponds to the rear side of the TV receiver 1.

Figure 7:
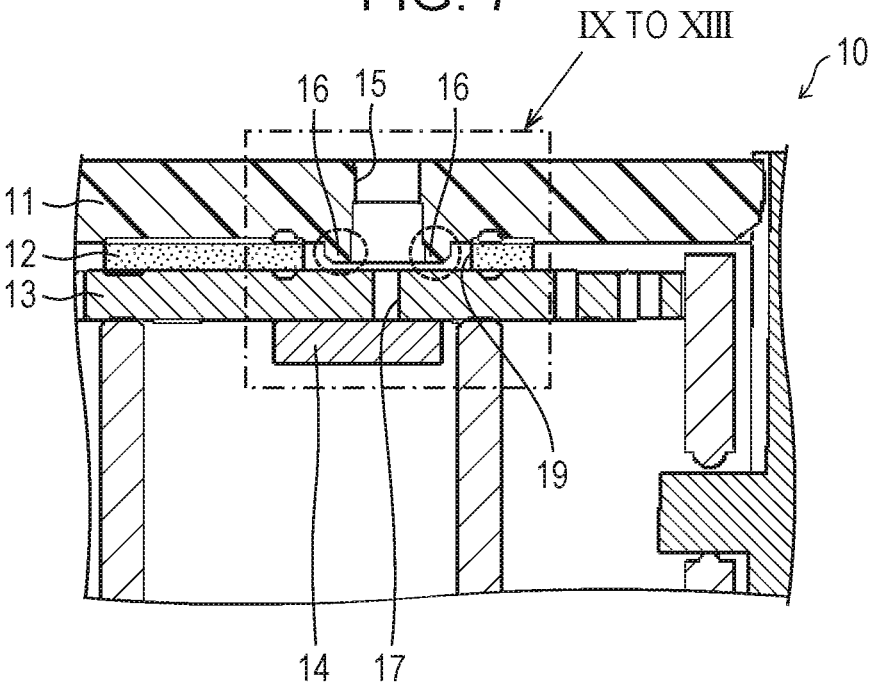
FIG. 7 is an enlarged view of a portion that is surrounded by a one-dot chain line frame VII in FIG. 5.

FIG. 7 is an enlarged view of a portion that is surrounded by a one-dot chain line frame VII in FIG. 5. Note that the components illustrated in FIG. 5 are turned upside down in FIG. 7, and in FIG. 7, the upper side corresponds to the front side of the TV receiver 1 (or the microphone unit apparatus 10), and the lower side corresponds to the rear side of the TV receiver 1. The configuration of the peripheral portion of one of the sound receiving holes 15 formed in the microphone unit apparatus 10 in the embodiment will be described in detail below with reference to FIG. 7.

As described above, the front surface portion of the microphone unit apparatus 10 is covered with the housing 11, and the sound receiving holes 15 formed in the housing 11 guide an external sound into the housing 11. In addition, the housing 11 includes space-occupying members 16 each of which is positioned so as to partially occupy a corresponding one of the spaces. Note that the space-occupying members will hereinafter also be referred to as first members. As illustrated in FIG. 7, each of the first members 16 may be formed in such a manner as to project from the inner wall of the housing 11 toward the corresponding space.

The microphones 14 are mounted on the substrate 13, which is disposed in the housing 11. In the present embodiment, the microphones 14 are arranged on a surface of the substrate 13, the surface being opposite to the surface of the substrate 13 that faces the spaces. The substrate 13 has sound guiding holes 17 each extending between the surface of the substrate 13 that faces the spaces and the surface of the substrate 13 on which the microphones 14 are arranged.

The elastic members 12 are arranged so as to fill the gap between the substrate 13 and the inner wall of the housing 11 excluding the portions of the inner wall that are located around the sound receiving holes 15 and so as to form the spaces between the substrate 13 and the portions of the inner wall of the housing 11, which are located around the sound receiving holes 15.

The elastic members 12 are formed of an elastic cushion material such as rubber, urethane, or urethane foam and fill the gap between the substrate 13 and the housing (a front cover) 11. The elastic members 12 bring the substrate 13 and the housing 11 into close contact with each other so as to prevent a sound from entering from any space other than the sound receiving holes 15 of the housing 11. As illustrated in FIG. 7, the elastic members 12 has holes 19 each of which connects one of the sound receiving holes 15 and the corresponding sound guiding hole 17. The sound guided into the housing 11 by the sound receiving holes 15 is guided to the microphones 14 by the holes 19 of the elastic members 12 and the sound guiding holes 17. A double-sided adhesive tape that serves as a fixing unit is provided between each of the elastic members 12 and the substrate 13.

The elastic members 12 are fixed to the substrate 13 by the double-sided adhesive tapes, and the substrate 13 is placed on the elastic members 12. The elastic members 12 and the substrate 13 are sandwiched between the housing 11 and the substrate holder 20, and the housing 11 and the substrate holder 20 are fastened and fixed to each other with the fixing screws S.

The entire sound hole of the microphone unit apparatus 10 is the path of a sound that is formed so as to extend from the sound receiving holes 15 of the housing 11 to the sound guiding holes 17 of the substrate 13 and is formed of the spaces of the sound receiving holes 15 in the housing 11, the spaces of the sound guiding holes 17 in the substrate 13, and the spaces of the holes 19 in the elastic members 12.

In such a configuration, a sound enters the holes 19 from the sound receiving holes 15. In this case, the entire sound hole functions as a resonance space, and the sound enters the microphones 14 through the sound guiding holes 17 of the substrate 13. The microphones 14 convert the sound input thereto into an electrical signal, and an electrical signal that has a level corresponding to the converted sound is obtained.

What is important here is the size (the volume) of the entire sound hole. For example, in order to enable the TV receiver 1 to have a hands-free voice recognition function, a far-field microphone that picks up a distant sound is necessary, and in this case, the smaller the size of the sound hole of the microphone unit apparatus 10, the better the acoustic characteristics of sound collection and the higher the voice recognition rate.

Thus, each of the holes 19 formed in the elastic members 12 may also be small. However, the elastic members 12 are each made of a material different from that of the substrate 13 and that of the housing 11, and thus, it is necessary to attach the elastic members 12 to the substrate 13 and the housing 11 in a manufacturing process. Consequently, in order to avoid the risk of blocking the sound holes during assembly, the holes 19 of the elastic member 12 may be formed as large as possible. However, as mentioned above, the smaller the volume of each of the sound holes, the better the acoustic characteristics of sound collection, and the higher the voice recognition rate. Thus, the first members 16 are provided in the housing 11 so as to double the portions surrounding the sound holes and so as to reduce the volume of the entire sound hole, so that the sound receiving characteristics can be improved, and the voice recognition rate can be improved.

Figure 8:
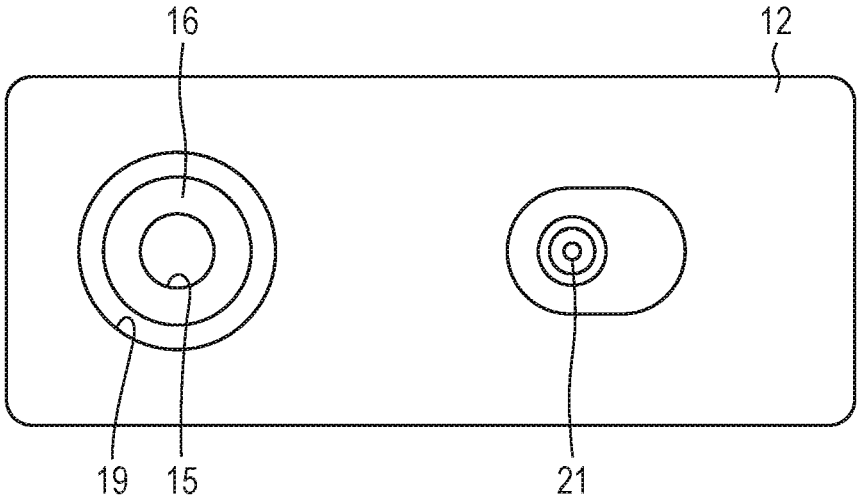
FIG. 8 is a diagram illustrating a state in which a substrate is mounted on a housing of the microphone unit apparatus illustrated in FIG. 2 when viewed from the inner side of the housing.

FIG. 8 is a diagram illustrating a state in which the substrate 13 is mounted on the housing 11 when viewed from the inner side of the housing 11. At the time of assembly, it is necessary to align the sound receiving holes 15 and the holes 19, which are formed in the elastic members 12, so as not to block the sound holes. Thus, as illustrated in FIG. 8, the housing 11 are provided with positioning ribs 21, and the elastic members 12 have positioning holes formed at positions corresponding to the positioning ribs 21, so that the housing 11 and the elastic members 12 are correctly positioned, and displacement of the elastic members 12 in the lateral direction is prevented.

Variations of Embodiment

The configuration according to the embodiment, which has been described above, is an example of the present disclosure, and there are various conceivable variations of the configuration of the peripheral portion of each of the sound receiving holes 15 formed in the electronic apparatus 1 of the present disclosure other than the configuration according to the above-described embodiment. FIG. 9 to FIG. 13 are diagrams illustrating variations of the configuration of the portion surrounded by the one-dot chain line frame in FIG. 7. These variations of the configuration will be described below.

[Variation 1]

Figure 9:
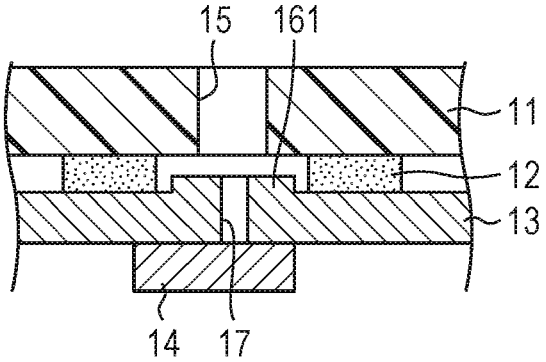
FIG. 9 is an enlarged view of a portion that is surrounded by a one-dot chain line frame IX in FIG. 7.

In the embodiment, the configuration example in which the first members 16 are each formed so as to project from the inner wall of the housing 11 toward the corresponding space has been described. However, each of the first members 16 may be formed so as to project from the substrate 13 toward the corresponding space. For example, as illustrated in FIG. 9, first members 161 may be provided integrally with the substrate 13.

According to the above-described configuration, when the design of the first members 161 is changed, it is not necessary to change the mold of the housing 11, and the manufacturing process can be simplified.

[Variation 2]

Figure 10:
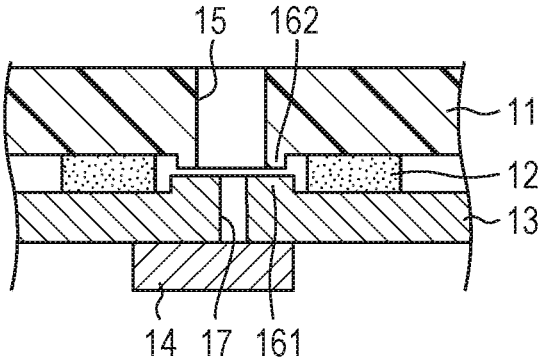
FIG. 10 is an enlarged view of a portion that is surrounded by a one-dot chain line frame X in FIG. 7.

The first members may project from both the housing 11 and the substrate 13 toward the spaces. For example, as illustrated in FIG. 10, first members 162 may be formed so as to project from the housing 11 toward the spaces, and the first members 161 may be formed so as to project from the substrate 13 toward the spaces.

According to the above-described configuration, since the first members 161 and 162 project from both the housing 11 and the substrate 13 toward the spaces, the volumes of the entire spaces can be further reduced, and the acoustic characteristics of sound collection can be improved.

[Variation 3]

Figure 11:
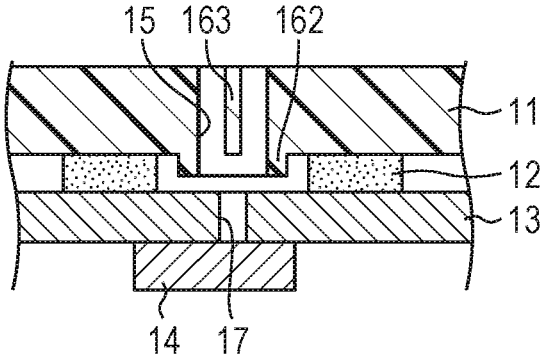
FIG. 11 is an enlarged view of a portion that is surrounded by a one-dot chain line frame XI in FIG. 7.

The microphone unit apparatus 10 may include space-occupying members (hereinafter also referred to as second members) 163 each of which is disposed so as to partially occupy one of the sound receiving holes 15. For example, as illustrated in FIG. 11, a plurality of sound receiving holes may be formed in the housing 11 by the second members 163 each of which projects from the side on which the housing 11 is disposed toward the corresponding space. Here, each of the "second members" is one of the variations of the "space-occupying member".

According to the above-described configuration, by providing the second members 163, the volumes of the entire spaces can be further reduced, and the acoustic characteristics of sound collection can be improved.

[Variation 4]

Figure 12:
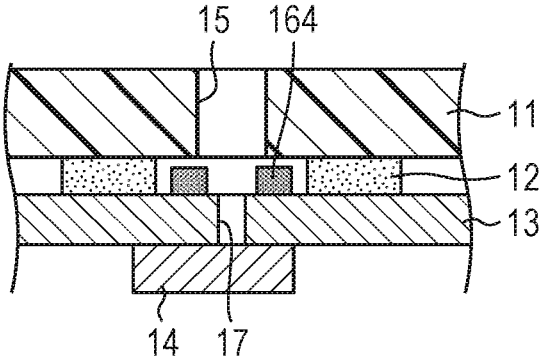
FIG. 12 is an enlarged view of a portion that is surrounded by a one-dot chain line frame XII in FIG. 7.

In the microphone unit apparatus 10, first members 164 may be arranged on the substrate 13 on the side on which the spaces are present. For example, as illustrated in FIG. 12, the first members 164 each of which is a different member from both the housing 11 and the substrate 13 may be arranged on the substrate 13. The first members 164 may be, for example, components of the microphone unit apparatus 10 that are mounted on the substrate 13. In addition, the positions at which the first members 164 are arranged, the shapes and the sizes of the first members 164, and so forth may be arbitrary.

According to the above-described configuration, since the first members 164 each of which is a different member from both the housing 11 and the substrate 13 can be arranged on the substrate 13, the shapes, the sizes, and the arrangement positions of the first members 164 can be freely designed.

[Variation 5]

Figure 13:
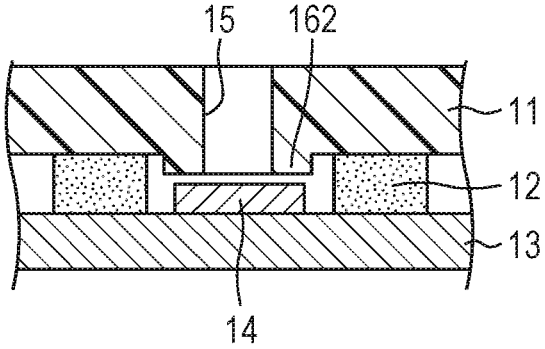
FIG. 13 is an enlarged view of a portion that is surrounded by a one-dot chain line frame XIII in FIG. 7.

As illustrated in FIG. 13, in the microphone unit apparatus 10, the microphones 14 may be arranged on the substrate 13 on the side on which the spaces are present.

According to the above-described configuration, the volumes of the spaces are reduced as a result of the spaces being partially occupied by the microphones 14, and thus, by combining this arrangement of the microphones 14 with the first members 162, the acoustic effect of sound collection can be increased. In addition, it is not necessary to form sound guiding holes in the substrate 13, and thus, the manufacturing process can be simplified.

In the microphone unit apparatus 10, after arranging the microphones 14 on the substrate 13 on the side on which the spaces are present, first members each of which is a separate member from the microphones 14, the housing 11, and the substrate 13 may further be arranged, like the microphones 14, at unoccupied positions on the substrate 13 on the side on which the spaces are present. Each of the first members may be attached, with a double-sided adhesive tape or an adhesive, to an area of a surface of a corresponding one of the microphones 14, the surface of the microphone 14 being opposite to a surface of the microphone 14 that is in contact with the substrate 13, in such a manner that the area of the surface of the microphone 14 to which the first member is attached has such a size that the sound receiving performance of the microphone 14 does not deteriorate. In such a configuration, the volumes of the spaces can be reduced by the microphones 14 and the first members, which are arranged on the substrate 13 on the side on which the spaces are present, and the acoustic effect of sound collection can be increased.

In addition, the microphone unit apparatus 10 in which the first members, each of which may be a separate member from the microphones 14, the housing 11, and the substrate 13, are arranged on the substrate 13 on the side on which the spaces are present, may further include the first members 162 that project from the housing 11 as illustrated in FIG. 13. In such a configuration, the volumes of the spaces can be reduced by the microphones 14, the first members 162 which project from the housing 11, and the first members, each of which may be a separate member from the microphones 14, the housing 11, and the substrate 13, and the acoustic effect of sound collection can be further increased.

FIGS. 14 to 21 are diagrams illustrating various variations of the state in which each of the elastic members 12 is attached to the housing 11 when viewed from the rear surface side of the microphone unit apparatus 10 (i.e., the inner side of the housing 11). The configurations of the various variations will be described from a different angle below with reference to FIGS. 14 to 21.

[Variation 6]

Figure 14:
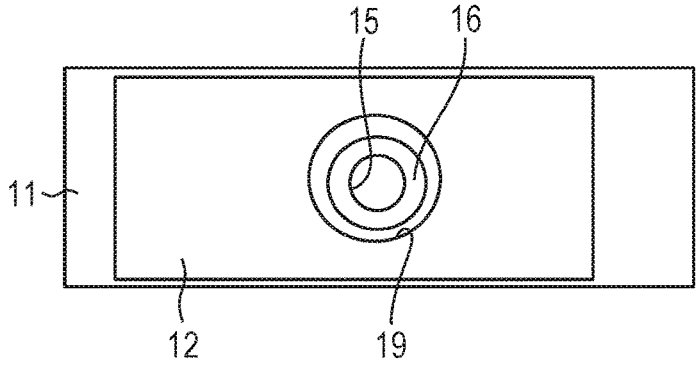
FIG. 14 is a diagram illustrating an example of the state in which elastic members are attached to the housing of the microphone unit apparatus illustrated in FIG. 2.

In Variation 6, as illustrated in FIG. 14, each of the first members 16 may have an annular shape and surrounds the entire corresponding receiving hole 15 when viewed in cross section. The inner diameter of each of the first members 16 may be equal to the outer diameter of the corresponding sound receiving hole 15. In other words, FIG. 14 corresponds to a sectional view of FIG. 7.

According to the above-described configuration, the volumes of the first members 16 can be increased, and the acoustic effect of sound collection can be improved.

[Variation 7]

Figure 15:
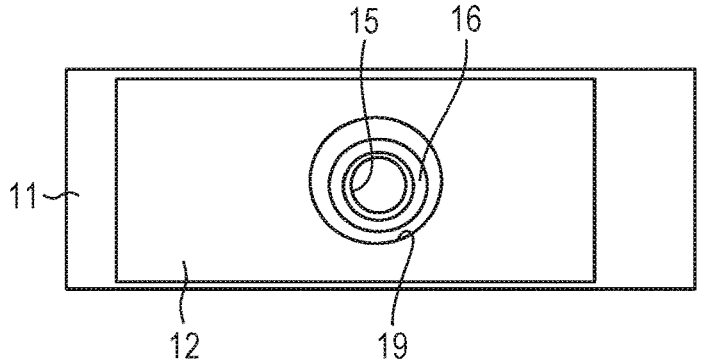
FIG. 15 is a diagram illustrating the state in which the elastic members are attached to the housing of the microphone unit apparatus illustrated in FIG. 2.

In Variation 7, as illustrated in FIG. 15, each of the first members 16 may have an annular shape and surrounds the entire periphery of the corresponding receiving hole 15 when viewed in cross section. The inner diameter of each of the first members 16 may be larger than the outer diameter of the corresponding sound receiving hole 15.

According to the above-described configuration, the efficiency of the operation of forming the sound receiving holes 15 into the housing 11 afterward by using a drill can be improved.

[Variation 8]

Figure 16:
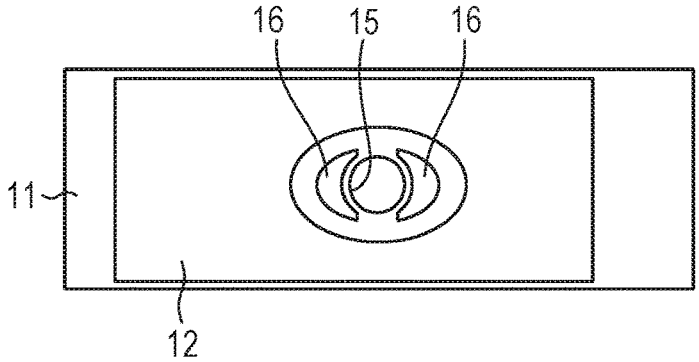
FIG. 16 is a diagram illustrating an example of the state in which the elastic members are attached to the housing of the microphone unit apparatus illustrated in FIG. 2.

In Variation 8, the first members 16 may be disposed so as to partially surround their respective sound receiving holes 15. For example, as illustrated in FIG. 16, two first members 16 each having a crescent shape may be provided for each of the sound receiving holes 15 such that the two first members 16 do not surround the entire periphery of the corresponding sound receiving hole 15 and such that the two first members 16 surround the corresponding sound receiving hole 15 only in the lateral direction in FIG. 16.

According to the above-described configuration, the first members 16 can be suitably arranged when there is not enough space in the vertical direction. In addition, by arranging the first members 16 away from their respective sound receiving holes 15, the efficiency of the operation of forming the sound receiving holes 15 into the housing 11 using a drill that is performed afterward can be improved.

[Variation 9]

Figure 17:
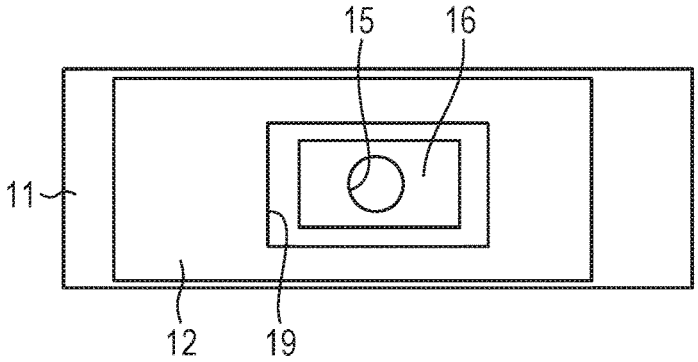
FIG. 17 is a diagram illustrating an example of the state in which the elastic members are attached to the housing of the microphone unit apparatus illustrated in FIG. 2.
Figure 18:
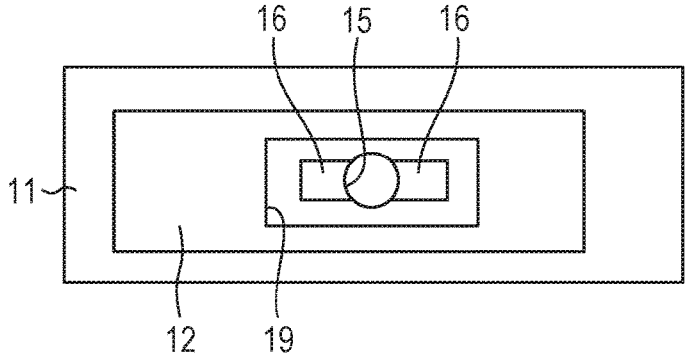
FIG. 18 is a diagram illustrating an example of the state in which the elastic members are attached to the housing of the microphone unit apparatus illustrated in FIG. 2.

In the embodiment and the above-described variations, a case has been described in which the spaces and the outer edges of the first members 16 each have an annular shape. However, in the microphone unit apparatus 10 of the present disclosure, each of the spaces may have a polygonal shape when viewed in a direction normal to the housing 11, and the outer edge of each of the first members 16 may have a polygonal shape when viewed in the direction normal to the housing 11. For example, as illustrated in FIG. 17 and FIG. 18, the spaces and the outer edges of the first members 16 may each have a rectangular shape. In addition, as illustrated in FIG. 18, each of the first members 16 may be disposed so as to surround the sound receiving holes 15 only in the lateral direction.

According to the above-described configuration, by forming each of the first members 16 into a polygonal shape, the volumes of the first members 16 can be increased. As a result, the volumes of the spaces can be reduced, and the acoustic effect of sound collection can be improved.

[Variation 10]

Figure 19:
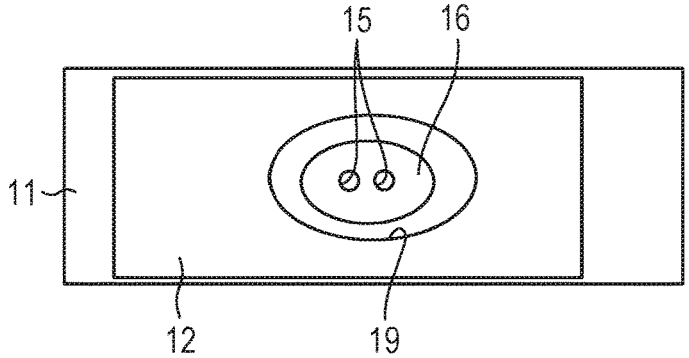
FIG. 19 is a diagram illustrating an example of the state in which the elastic members are attached to the housing of the microphone unit apparatus illustrated in FIG. 2.

In Variation 10, as illustrated in FIG. 19, the plurality of sound receiving holes 15 may be formed in the housing 11, and holes may be formed at positions that correspond to the sound receiving holes 15. Note that the above-mentioned holes are holes that are formed in the first members 16 and partition the inner edges of the first members 16.

According to the above-described configuration, the areas of the spaces can be made relatively small, and the acoustic characteristics of sound collection can be improved.

[Variation 11]

Figure 20:
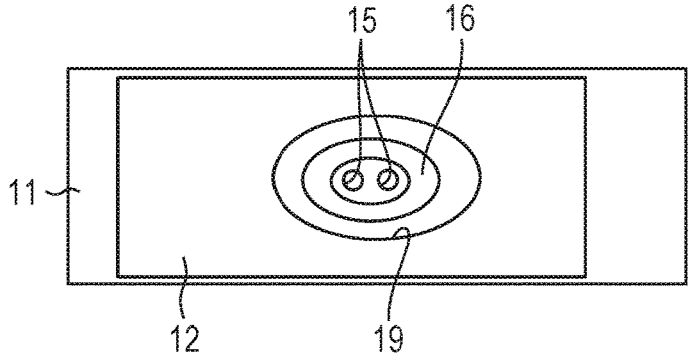
FIG. 20 is a diagram illustrating an example of the state in which the elastic members are attached to the housing of the microphone unit apparatus illustrated in FIG. 2.

In Variation 11, as illustrated in FIG. 20, the plurality of sound receiving holes 15 may be formed in the housing 11, and each of the first members 16 may have an annular shape. In addition, the inner edge of each of the first members 16 may be positioned outside the outer edge of the corresponding sound receiving hole 15.

According to the above-described configuration, the areas of the spaces can be made relatively small, and the acoustic characteristics of sound collection can be improved. The efficiency of the operation of forming the sound receiving holes 15 into the housing 11 using a drill that is performed afterward can be improved.

[Variation 12]

Figure 21:
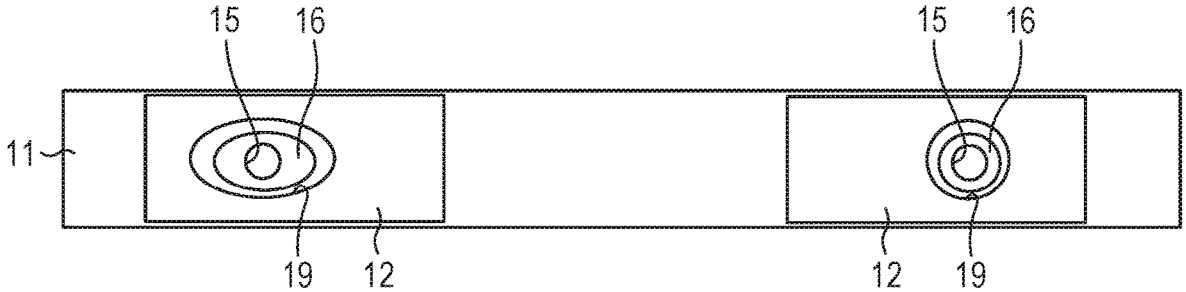
FIG. 21 is a diagram illustrating an example of the state in which the elastic members are attached to the housing of the microphone unit apparatus illustrated in FIG. 2.

In the present embodiment, an electronic apparatus may include a housing having a first sound receiving hole group and a second sound receiving hole group that guide a sound outside the housing into the housing, a substrate that is disposed in the housing and on which a first microphone that receives a sound through the first sound receiving hole group and a second microphone that receives a sound through the second sound receiving hole group are mounted, a first elastic member that is disposed so as to fill a gap between the substrate and an inner wall of the housing excluding a portion of the inner wall that is located around the first sound receiving hole group and so as to form a first space between the substrate and the portion of the inner wall of the housing, which is located around the first sound receiving hole group, a second elastic member that is disposed so as to fill a gap between the substrate and the inner wall of the housing excluding a portion of the inner wall that is located around the second sound receiving hole group and so as to form a second space between the substrate and the portion of the inner wall of the housing, which is located around the second sound receiving hole group, a third member that is disposed so as to partially occupy the first space, and a fourth member that is disposed so as to partially occupy the second space. One of the following conditions may be satisfied: the third member and the fourth member are arranged at different positions, the third member and the fourth member have different shapes, the first space and the second space have different volumes, and the first sound receiving hole group and the second sound receiving hole group include different numbers of sound receiving holes. For example, as illustrated in FIG. 21, the third member 16 that is positioned around the first microphone 14 on the left-hand side may be larger in size, and the fourth member 16 that is positioned around the second microphone 14 on the right-hand side may be smaller in size. Alternatively, the third member 16 may not be provided around the first microphone 14, and the fourth member 16 may be provided only around the second microphone 14. Note that the third member and the fourth member are each one of the variations of the "space-occupying member". According to the above-described configuration, one of the microphones can pick up a near-field sound, and the other of the microphones can pick up a far-field sound. Therefore, the microphone unit apparatus 10 can handle both near-field and far-field sounds.

[Manufacturing Method]

An example of a method of manufacturing the microphone unit apparatus 10 will now be described. The method of manufacturing the microphone unit apparatus 10 includes a molding process, a substrate molding process, and an assembly process, which will be described below.

(a) Molding Process

The housing 11 and the substrate holder 20 are molded beforehand. The elastic members 12 are each processed into a predetermined shape.

(b) Substrate Molding Process

The substrate 13 is molded, and the microphones 14 and the other components are mounted onto the substrate 13.

(c) Assembly Process

A double-sided adhesive tape is attached to a portion of a surface of each of the elastic members 12, the portion of the surface being surrounded by a protrusion of the elastic member 12. The elastic members 12 are placed onto the substrate 13, after which the substrate holder 20 is placed onto the substrate 13 so as to cover the substrate 13 and is fitted into the housing 11. In this case, the positioning ribs 21 formed on the housing 11 are inserted into the holes formed in the substrate 13. As a result, positional deviation between the sound guiding holes 17 of the substrate 13 and the sound receiving holes 15 of the housing 11 can be prevented.

In addition, by latching the substrate holder 20 onto one or more hooks of the housing 11, the substrate 13 can be fixed in place while being pushed from the rear surface side. The substrate holder 20 and the housing 11 are fixed to each other with the fixing screws S, and the assembly process is completed.

The assembly is manually performed, and if the holes 19 of the elastic members 12 are too small, misalignment or the like occurs among the sound receiving holes 15 of the housing 11, the sound guiding holes 17 of the substrate 13, and the holes 19 of the elastic members 12 at the time of the assembly due to, for example, variations that occur as a result of different operators performing the assembly, variations that occur during the operation, or variations in the dimensions of the holes 19 of the elastic members 12, so that the path of sound will be blocked, and there is a risk that the microphones 14 will not receive any sound and will not recognize any voice.

In contrast, according to the present disclosure, the holes 19 of the elastic members 12 can be made reasonably large, and thus, by using the above-described manufacturing method, mass production of the microphone unit apparatus without problem can be achieved even though the assembly process is manually performed.

[Summary]

[Aspect 1]

The electronic apparatus according to an aspect of the present disclosure includes a housing having at least one sound receiving hole that guides a sound outside the housing into the housing, a substrate that is disposed in the housing and on which a microphone is mounted, an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole, and a first member that is disposed so as to partially occupy the space.

According to the above-described configuration, the volume of the space is reduced by the first member disposed so as to partially occupy the space, and thus, the acoustic characteristics of the apparatus can be improved. In addition, since the volume of the space can be reduced by providing the first member, it is not necessary to make the sound receiving hole and a hole that is formed in the elastic member small, and thus, alignment of the holes may be easily performed in a manufacturing process.

[Aspect 2]

In the electronic apparatus according to an aspect of the present disclosure, the first member may be formed in such a manner as to project from the inner wall of the housing toward the space.

According to the above-described configuration, the first member can be molded integrally with the housing, and thus, the manufacturing costs of the electronic apparatus can be reduced.

[Aspect 3]

In the electronic apparatus according to an aspect of the present disclosure, the first member may have an annular shape, and the first member may have an inner diameter that is equal to an outer diameter of the sound receiving hole.

According to the above-described configuration, the volume of the first member can be increased, and the acoustic effect of sound collection can be improved.

[Aspect 4]

In the electronic apparatus according to an aspect of the present disclosure, the first member may have an annular shape, and the first member may have an inner diameter that is larger than an outer diameter of the sound guiding hole.

According to the above-described configuration, the efficiency of an operation of forming a sound receiving hole using a drill that is performed afterward can be improved.

[Aspect 5]

In the electronic apparatus according to an aspect of the present disclosure, the first member may be disposed so as to partially surround the sound receiving hole.

According to the above-described configuration, the efficiency of the operation of forming the sound receiving hole using a drill that is performed afterward can be improved.

[Aspect 6]

In the electronic apparatus according to an aspect of the present disclosure, the space may have a polygonal shape when viewed in a direction normal to the housing, and an outer edge of the first member may have a polygonal shape when viewed in a direction normal to the housing.

According to the above-described configuration, by forming the first member into a polygonal shape, the volume of the first member can be increased. As a result, the volume of the space can be reduced, and the acoustic effect of sound collection can be improved.

[Aspect 7]

In the electronic apparatus according to an aspect of the present disclosure, the housing may have a plurality of the sound receiving holes, and in the first member, holes may be formed at positions corresponding to the sound receiving holes.

According to the above-described configuration, the area of the space can be made relatively small.

[Aspect 8]

In the electronic apparatus according to an aspect of the present disclosure, the housing may have a plurality of the sound receiving holes. The first member may have an annular shape. An inner edge of the first member may be positioned outside an outer edge of the sound receiving hole.

According to the above-described configuration, the area of the space can be made relatively small.

[Aspect 9]

The electronic apparatus according to an aspect of the present disclosure may further include a second member that is disposed so as to partially occupy the sound receiving hole.

According to the above-described configuration, by providing the second member, the volume of the entire space can be further reduced, and the acoustic characteristics of sound collection can be improved.

[Aspect 10]

In the electronic apparatus according to an aspect of the present disclosure, the first member may be disposed on the substrate on the side on which the space is present.

According to the above-described configuration, the first member may be formed as a different member from both the housing and the substrate, and thus, the arrangement position, the shape, the size, and so forth of the first member can be freely designed. In addition, it is not necessary to modify either the housing or the substrate, and a design change may be made in the first member. Thus, the manufacturing process can be simplified.

[Aspect 11]

In the electronic apparatus according to an aspect of the present disclosure, the first member may be formed in such a manner as to project from the substrate toward the space.

According to the above-described configuration, the first member can be molded integrally with the substrate, and thus, the manufacturing costs of the electronic apparatus can be reduced.

[Aspect 12]

In the electronic apparatus according to an aspect of the present disclosure, the microphone may be disposed on a surface of the substrate, the surface being opposite to a surface of the substrate that faces the space, and the substrate may have a sound guiding hole extending between the surface of the substrate that faces the space and the surface of the substrate on which the microphone is disposed.

According to the above-described configuration, the microphones 14 and the other components can be mounted on the same surface of the substrate. Thus, one surface of the substrate 13 can be made flat by mounting no components on the substrate 13 on the side on which the space is present, and the substrate 13 can be brought into close contact with the inner surface of the housing 11 at a minimum distance without any gap formed therebetween. Therefore, the volume of the entire space can be further reduced, and the acoustic characteristics of sound collection can be improved.

[Aspect 13]

In the electronic apparatus according to an aspect of the present disclosure, the microphone may be disposed on the substrate on the side on which the space is present.

According to the above-described configuration, it is not necessary to form a sound guiding hole into the substrate, and thus, the manufacturing process can be simplified.

[Aspect 14]

An electronic apparatus according to an aspect of the present disclosure includes a housing having a first sound receiving hole group and a second sound receiving hole group that guide a sound outside the housing into the housing, a substrate that is disposed in the housing and on which a first microphone that receives a sound through the first sound receiving hole group and a second microphone that receives a sound through the second sound receiving hole group are mounted, a first elastic member that is disposed so as to fill a gap between the substrate and an inner wall of the housing excluding a portion of the inner wall that is located around the first sound receiving hole group and so as to form a first space between the substrate and the portion of the inner wall of the housing, which is located around the first sound receiving hole group, a second elastic member that is disposed so as to fill a gap between the substrate and the inner wall of the housing excluding a portion of the inner wall that is located around the second sound receiving hole group and so as to form a second space between the substrate and the portion of the inner wall of the housing, which is located around the second sound receiving hole group, a third member that is disposed so as to partially occupy the first space, and a fourth member that is disposed so as to partially occupy the second space. One of the following conditions is satisfied: the third member and the fourth member are arranged at different positions, the third member and the fourth member have different shapes, the first space and the second space have different volumes, and the first sound receiving hole group and the second sound receiving hole group include different numbers of sound receiving holes.

According to the above-described configuration, by making the structures around the two microphones different from each other, the acoustic characteristics of sound collection for both sounds near and far from the electronic apparatus can be improved.

[Aspect 15]

A television receiver according to an aspect of the present disclosure includes a housing having a sound receiving hole that guides a sound outside the housing into the housing, a substrate that is disposed in the housing and on which a microphone is mounted, an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole, and a first member that is disposed so as to partially occupy the space.

According to the above-described configuration, advantageous effects similar to those of the electronic apparatus can be obtained.

The present disclosure is not limited to the embodiment and the variations of the embodiment, and various modifications can be made within the scope of the claims. The technical scope of the present disclosure also includes embodiments that are obtained by suitably combining the technical measures disclosed in the embodiment and the variations of the embodiment.

The present disclosure contains subject matter related to that disclosed in Japanese Priority Patent Application JP 2021-064833 filed in the Japan Patent Office on Apr. 6, 2021, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electronic apparatus comprising:

a housing having at least one sound receiving hole that guides a sound outside the housing into the housing;

a substrate that is disposed in the housing and on which a microphone is mounted;

an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole; and a first member that is disposed so as to partially occupy the space.

2. The electronic apparatus according to claim 1, wherein the first member is formed in such a manner as to project from the inner wall of the housing toward the space.

3. The electronic apparatus according to claim 1, wherein the first member has an annular shape, and wherein the first member has an inner diameter that is equal to an outer diameter of the sound receiving hole.

4. The electronic apparatus according to claim 1, wherein the first member has an annular shape, and wherein the first member has an inner diameter that is larger than an outer diameter of the sound receiving hole.

5. The electronic apparatus according to claim 1, wherein the first member is disposed so as to partially surround the sound receiving hole.

6. The electronic apparatus according to claim 1, wherein the space has a polygonal shape when viewed in a direction normal to the housing, and wherein an outer edge of the first member has a polygonal shape when viewed in the direction normal to the housing.

7. The electronic apparatus according to claim 1, wherein the housing has a plurality of the sound receiving holes, and wherein, in the first member, holes are formed at positions corresponding to the sound receiving holes.

8. The electronic apparatus according to claim 1, wherein the housing has a plurality of the sound receiving holes, wherein the first member has an annular shape, and wherein an inner edge of the first member is positioned outside an outer edge of the sound receiving hole.

9. The electronic apparatus according to claim 1, further comprising:

a second member that is disposed so as to partially occupy the sound receiving hole.

10. The electronic apparatus according to claim 1, wherein the first member is disposed on the substrate on a side on which the space is present.

11. The electronic apparatus according to claim 1, wherein the first member is formed in such a manner as to project from the substrate toward the space.

12. The electronic apparatus according to claim 1, wherein the microphone is disposed on a surface of the substrate, the surface being opposite to a surface of the substrate that faces the space, and wherein the substrate has a sound guiding hole extending between the surface of the substrate that faces the space and the surface of the substrate on which the microphone is disposed.

13. The electronic apparatus according to claim 1, wherein the microphone is disposed on the substrate on a side on which the space is present.

14. An electronic apparatus comprising:

a housing having a first sound receiving hole group and a second sound receiving hole group that guide a sound outside the housing into the housing;

a substrate that is disposed in the housing and on which a first microphone that receives a sound through the first sound receiving hole group and a second microphone that receives a sound through the second sound receiving hole group are mounted;

a first elastic member that is disposed so as to fill a gap between the substrate and an inner wall of the housing excluding a portion of the inner wall that is located around the first sound receiving hole group and so as to form a first space between the substrate and the portion of the inner wall of the housing, which is located around the first sound receiving hole group;

a second elastic member that is disposed so as to fill a gap between the substrate and the inner wall of the housing excluding a portion of the inner wall that is located around the second sound receiving hole group and so as to form a second space between the substrate and the portion of the inner wall of the housing, which is located around the second sound receiving hole group;

a third member that is disposed so as to partially occupy the first space; and a fourth member that is disposed so as to partially occupy the second space, wherein one of the following conditions is satisfied: the third member and the fourth member are arranged at different positions, the third member and the fourth member have different shapes, the first space and the second space have different volumes, and the first sound receiving hole group and the second sound receiving hole group include different numbers of sound receiving holes.

15. A television receiver comprising:

a housing having a sound receiving hole that guides a sound outside the housing into the housing;

a substrate that is disposed in the housing and on which a microphone is mounted;

an elastic member that is disposed so as to fill a gap between the substrate and an inner wall of the housing excluding a portion of the inner wall that is located around the sound receiving hole and so as to form a space between the substrate and the portion of the inner wall of the housing, which is located around the sound receiving hole; and a first member that is disposed so as to partially occupy the space.

* * * * *